United States Patent [19]

Jackson

[11] 3,958,934

[45] May 25, 1976

[54] RAPID FIXATION OF DISPERSE DYES ON SYNTHETIC POLYMERS

[75] Inventor: Harold Leonard Jackson, Hockessin, Del.

[73] Assignee: E. I. Du Pont de Nemours and Company, Wilmington, Del.

[22] Filed: July 5, 1974

[21] Appl. No.: 486,115

Related U.S. Application Data

[63] Continuation-in-part of Ser. No. 367,333, June 5, 1973, abandoned.

[52] U.S. Cl. ..... 8/174; 8/175; 8/93; 8/94 A; 8/164

[51] Int. Cl.[2] ..... D06P 1/68

[58] Field of Search ..... 8/174, 175, 93, 94, 8/164

[56] References Cited

UNITED STATES PATENTS

| | | | |
|---|---|---|---|
| 3,214,478 | 10/1965 | Millan | 260/615 |
| 3,242,218 | 3/1966 | Miller | 260/615 |
| 3,250,807 | 5/1966 | Fritz et al. | 260/535 |
| 3,634,014 | 1/1972 | Maltenfort | 8/18 |
| 3,667,898 | 6/1972 | Bergman | 8/94 |
| 3,679,349 | 7/1972 | von der Eltz | 8/17 |
| 3,762,872 | 10/1973 | Acree | 8/176 |
| 3,788,811 | 1/1974 | Sievenpiper | 8/175 |
| 3,792,977 | 2/1974 | Guenthner | 8/169 |

FOREIGN PATENTS OR APPLICATIONS

| | | |
|---|---|---|
| 2,002,286 | 7/1971 | Germany |
| 760,243 | 5/1971 | Belgium |

OTHER PUBLICATIONS

Byland et al., J. Amer. Assoc. Textile Chemists and Colorists, 1971, 3, (No. 10), pp. 210–215.

Sievenpiper et al., Kirk–Othmer, Encyclopedia of Chem. Tech., 2nd Edition, 1971, Suppl. Vol. "Solvent Dyeing", pp. 973–978.

Milicevic, Rev. Prog. Coloration, 1970, 1, 49.

*Primary Examiner*—Joseph L. Schofer
*Assistant Examiner*—A. L. Clingman

[57] ABSTRACT

Process wherein an organic disperse dye is applied, for example, to a synthetic organic polymer in the form of a film or textile fabric, for example, a polyethylene terephthalate fabric, by printing, spraying or padding and the dye-containing film or fabric is then passed through a fluorocarbon fluid at atmospheric pressure and at a temperature greater than the glass transition temperature of the polymer, said fluorocarbon having a boiling temperature of at least 125°C., a fluorine to carbon atom ratio of at least 1.5 and a solubility parameter of not greater than 7.0, preferably 6.5 or less, for example, a fluorocarbon of the formula $F[CF(CF_3)CF_2O]_nCHFCF_3$ wherein $n$ is at least 3.

13 Claims, No Drawings

RAPID FIXATION OF DISPERSE DYES ON SYNTHETIC POLYMERS

CROSS-REFERENCE TO RELATED APPLICATIONS

This is a continuation-in-part of application Ser. No. 367,333, filed June 5, 1973 and now abandoned.

BACKGROUND OF THE INVENTION

1. Field of the Invention

This invention relates to nonaqueous dyeing of synthetic polymers.

2. Description of the Prior Art

Solvent dyeing procedures, that is, dyeing procedures wherein an organic solvent is employed at least partially in place of water in conventional aqueous procedures such as aqueous exhaust dyeing procedures, represent a commercially significant means of dyeing synthetic polymers with disperse dyes. This means of dyeing is significant not only in batch processes but also in continuous processes. Continuous processes generally involve use of lesser volumes of liquids than batch processes; moreover, in continuous processes the disperse dye generally is applied to the substrate by a padding or printing operation. Continuous solvent dyeing processes may provide improved appearance in the dyed product and elimination of an after dyeing scour treatment and their use may preclude water damage to certain water sensitive fabrics such as stretch goods and knit fabrics. Byland et al. in the Journal of the American Association of Textile Chemists and Colorists, Vol. 3, No. 10, October 1971, pages 210–215, describe four solvent methods, all basically padding procedures, for application of a disperse dye: (1) application of a solvent-dye solution, (2) application of a solubilized dye composition, (3) application of a solvent-dye dispersion and (4) application of a solvent-aqueous dye emulsion. These four application methods can be employed in combination with, basically, three methods for dye fixation: (*a*) heating with saturated solvent vapor, (*b*) heating with hot air or steam and (*c*) heating with superheated solvent vapor.

Following is a representation of various possible application and fixation processes:

I. Aqueous padding, drying and saturated vapor fixation by (*a*).

II. Solvent padding by any of 1–4, drying and saturated vapor fixing by (*a*) or hot air (Thermosol) fixing by (*b*).

III. Solvent padding by any of 1–4, no drying and saturated vapor fixing by (*a*) or superheated vapor fixing by (*c*).

A process similar to Process I is known in the trade as the "Vapocol" process. A process similar to Process II with saturated vapor fixing is described in U.S. Pat. No. 3,667,898. A process similar to Process III with superheated vapor fixing is known in the trade as the "Solvofix" process. Such processes also are described by Byland et al., supra, and in Belgian Pat. No. 760,243.

Every liquid in a closed system, that is, wherein vapors are not lost from the system, exists in equilibrium with its vapors; the pressure of the vapor is called the vapor pressure. The vapor pressure of a pure liquid is primarily, but not entirely, a function of temperature. Expressed mathematically, $P_v = ke^{-\Delta H/RT}$ wherein $P_v$ is the vapor pressure, $k$ is a constant characteristic of the liquid, $e$ is the natural logarithmic Naperian base, $\Delta H$ is the heat of vaporization, $R$ is the universal gas constant and $T$ is the absolute temperature. For any liquid, once $k$ and $\Delta H$ are determined $P_v$ can be determined from $T$ and vice versa. If the vapor pressure $P_v$ is held constant and the vapor is heated to a higher temperature T′ (that is, T′ is larger than $T$ in the above equation), the vapor is said to be superheated. A superheated vapor cannot exist in equilibrium with a liquid phase; it must first be cooled to its saturated vapor temperature T. Thus, an advantage in the use of superheated trichloroethylene or tetrachloroethylene vapor, as disclosed by Byland et al., supra, is that the vapor can be used to heat the dyed textile without forming a liquid phase provided the vapor is not allowed to cool to its saturated vapor temperature. In contrast, a saturated vapor can only heat the textile by condensing to liquid.

U.S. Pat. No. 3,762,872 teaches the exposure of a cool moving web of fabric having unfixed dye thereon in a first zone to the saturated vapors of a solvent, whereby it is taught that liquid acting as the dyeing medium is condensed thereon. Immediately thereafter the fabric is exposed to superheated vapors which evaporate the condensed solvent and fixes the dye. Tetrachloro- and trichloroethylene are exemplified; various chlorocarbons, chlorofluoro-carbons and fluorocarbons such as perfluoroheptane, perfluorohexane, and perfluoro(2,2,4-trimethyl)pentane are taught to be operable.

U.S. Pat. No. 3,667,898 discloses generically the use of numerous solvents for dyeing, including tri- and tetrachloroethylene and $C_{1-4}$, chlorinated and fluorinated, saturated aliphatic hydrocarbons. German Published Application No. 2,002,286 discloses the pad application of dyes from fluorinated solvents, for example, $CFCl_3$, $C_2F_3Cl_3$, $C_2F_4Cl_2$, with fixation being effected with hot air, with superheated steam or with vapors or organic solvents (undefined), the vapors being at a temperature of 105°–130°C. This publication also discloses that fixation can be effected by contacting the padded material with molten metal (also disclosed in U.S. Pat. No. 3,634,014 and German Published Application No. 1,963,015), paraffin waxes, oxalkylation products of alcohols or fatty acids and eutectic salt melts at 100°–220°C. British Pat. No. 1,130,354 discloses fixing of dyes by means of a hot oil bath.

With the exception of the solvent vapor and hot air fixation methods, all the aforesaid methods generally leave residues on the dyed fabric and, hence, are disadvantageous in that the residues must be removed. Similarly, although tetrachloroethylene solvent vapors may lead to more rapid fixation than hot air fixation, since tetrachloroethylene may be retained in the fibers, a removal step may be required.

OBJECTS AND SUMMARY OF THE INVENTION

It is an object of this invention to provide a dye fixation system which can be carried out without fiber imbibing of the fixing agent. Another object is to provide a process characterized by reduced diffusional losses of fluid and simplified machinery design. A further object is to provide a process having such high dye fixation rates that greater productivities can be achieved than by prior art methods. In summary, the invention resides in a process wherein an organic disperse dye is applied to a synthetic organic polymer, in the form of a film or textile fabric, for example, by spraying, printing or padding, and the dye-containing film or fabric is then passed through a fluorocarbon fluid at a temperature greater than the glass transition temperature (Tg) of the polymer for sufficient time to fix the dye in the polymer, said fluorocarbon having a boiling temperature of at least 125°C., a fluorine to carbon atom ratio of at least 1.5 and a solubility parameter of not greater than 7.0, preferably 6.5 or less. Preferred embodiments include such a process wherein the polymer is selected from acid modified polyacrylics (modacrylics), polyesters, nylons and cellulose triacetate, especially polyesters; wherein the dyed film or fabric is also heat set; wherein the sprayed, printed or padded film or fabric is dried before being passed through the fluorocarbon fluid; and wherein the fluorocarbon is of the formula $F[CF(CF_3)CF_2O]_nCHFCF_3$ wherein $n$ is 3–7.

DETAILED DESCRIPTION OF THE INVENTION

This invention, as summarized above, is directed to a process, preferably carried out continuously, for dyeing synthetic organic polymers, especially those in the form of films or textile fabrics. In this process an organic disperse dye is first applied to the synthetic polymer, for example, by spraying, padding or printing, and the dye-treated polymer, optionally dried, is then passed through a fluorocarbon fluid at a temperature greater than the glass transition temperature of the polymer for sufficient time to fix the disperse dye in the synthetic polymer. The fluorocarbon fluid must have a boiling temperature of at least 125°C., a fluorine to carbon atom ratio of at least 1.5 and a solubility parameter, as hereinafter defined, of not greater than 7.0, preferably 6.5 or less. If deemed necessary after fixing, the dyed synthetic polymer can be scoured.

As the term is used herein, a synthetic organic polymer includes any synthetic organic polymeric material which is normally dyeable with disperse dyes under art recognized conditions for aqueous disperse dyeing. Such polymeric materials include acid modified polyacrylics (modacrylics), polyesters, polyamides and cellulose acetates such as cellulose diacetate and cellulose triacetate. Polyesters, such as polyethylene terephthalate, and nylons, such as 6/6 nylon, are especially useful in the process of this invention. The synthetic polymer can be used alone or it can be blended with other materials, such as cotton or wool.

Organic disperse dyes are a well known group of dyes having in common the property of being free of water-solubilizing ionic groups. Disperse dyes are derived from all of the major and known chromophoric color systems. A majority of commercially available disperse dyestuffs are derived from azo, anthraquinone, quinophthalone, oxazine, stilbene, benzothioxanthene or benzoxanthene systems, although other types are also well known. Disperse dyes may also be metallized compounds. Disperse dyes are distinguished from organic pigments in that the former are usually soluble in common organic solvents, such as N,N-dimethylformamide, whereas the latter are not. Any known disperse dye which can be used to dye the aforementioned synthetic polymers, especially in the form of films or fabrics, by aqueous dyeing procedures can be used in the process of this invention. Moreover, since water insoluble brightening agents are useful in the process of this invention, such agents are considered herein as disperse dyes.

As indicated above, the first step in the process of this invention is the application, for example, by spraying, padding or printing, of the disperse dye to the synthetic polymer. The nature of the spraying, padding or printing system is critical only to the extent that it must be suitable for the form and nature of the synthetic polymer being treated. For example, padding can be effected by application of a solvent-dye solution, a solubilized dye composition, a solvent-dye dispersion or a solvent-aqueous dye emulsion; aqueous padding or printing methods, employing an emulsion of the disperse dye, also can be used. The use of a solvent system is preferred.

Spraying, padding or printing with aqueous emulsions or dispersions of disperse dyes employing conventional equipment is well known in the art. Printing may be done, for example, by electrostatic printing as disclosed in U.S. Pat. No. 3,081,698. In padding operations the degree of loading of disperse dye usually is controlled by adjustment of squeeze rolls or equivalent equipment. In spraying, the loading is controlled by adjustment of spray volume versus fabric travel rate. Preparation of the dye spray or pad bath varies with the disperse dye being applied; the art discloses numerous suitable methods for preparing baths from all types of disperse dyes. Typical aqueous pad baths and application methods are illustrated in the examples below.

Of the four solvent pad systems described above, solutions or solubilized compositions are less commonly used since solvent soluble disperse dyes are less common although not rare. There are presently commercially available some solvent soluble disperse dyes which are sold specifically for solvent dye systems. Solubilized dyes require specific combinations of disperse dyes and solubilizing agents. Such agents are not necessarily available for all available disperse dyes and may be rather unique and specific for individual dyes.

Dispersions of disperse dye in solvent (diluent) are prepared in a manner analogous to aqueous systems. Although a suitable dispersing agent is not always required, the use of such is usually preferred. Dyes in a sufficiently fine state of subdivision may form dispersions in some cases without the aid of a dispersing agent but the dyeings may be less uniform than if a dispersing agent is used. To a considerable degree the choice of dispersing agent depends on the combination of dye and solvent; selection of the ideal dispersing agent may require some experimentation. When fluorinated solvents are used, fluorinated dispersing agents are generally more useful although many nonfluorinated dispersing agents are also sufficiently soluble in the fluorinated solvents to be useful.

In preparing the solvent-aqueous dye emulsion systems, a concentrated aqueous emulsion of the disperse dye, prepared in the usual manner, is emulsified in the solvent. Often, the dispersing agent used to disperse the dye in water can be used to emulsify the aqueous system in the solvent. If it is unsatisfactory, a second dispersing or emulsifying agent, preferably one more soluble in the solvent, can be added.

Although a wide variety of application solvents are suggested in the art, for example, the art cited above, the preferred solvents usually are chlorinated solvents, such as trichloroethylene and tetrachloroethylene, and fluorinated solvents, such as fluorotrichloromethane, trichlorotrifluoroethane and dichlorotetrafluoroethane. Other application solvents and combinations which have also been found particularly useful include the fluorinated ethers of the formula $F[CF(CF_3)CF_2O]_nCHFCF_3$ wherein $n$ is an integer, particularly 2 or 3, alone or admixed with trichlorotrifluoroethane, and N,N-dimethylformamide, alone or admixed with trichlorotrifluoroethane. Dimethylformamide is particularly useful for preparing disperse dye solutions but since it is a powerful organic solvent, it first must be tested to determine its effect on the synthetic polymer being dyed. When fluorinated solvents are employed, it is generally preferable to use fluorinated dispersing agents, many types of which are known in the art.

Subsequent to application, for example, by spraying, padding or printing, a drying step (optional) may be desirable. Particularly when aqueous systems are used, drying may be desirable to remove excess water prior to contacting the dye-containing material with the fluorocarbon fluid, but even then, drying is not essential since it will occur during the next step of the process. Drying prior to fixation may also be desirable to remove strong solvents, such as dimethylformamide.

The next step of the process of this invention involves contacting the synthetic polymer having disperse dye applied thereto with a fluorocarbon fluid at a temperature above the glass transition temperature of the synthetic polymer. As the terms are used herein, a fluorocarbon is one having an atmospheric boiling temperature of at least 125°C. and a fluid includes both liquids and vapors or gases. This contacting step of the process has three variations which require somewhat different manipulations and equipment (1) treatment with fluorocarbon liquid; (2) treatment with fluorocarbon saturated vapor; or (3) treatment with superheated fluorocarbon vapor. The variation chosen will depend of the fluorocarbon selected and the fixation temperature necessary. Continuous fixation equipment wherein the treated fabric is passed through the bath over a series of rollers, in a fashion much like a pad bath, can be fabricated readily. Descriptions of fixation equipment which is useful herein are available in the prior art.

The glass transition temperature of the synthetic polymer varies not only with the chemical nature of the polymer but also with its past history. For example, polyethylene terephthalate has a glass transition temperature of 67°C. in the amorphous condition, 81°C. in the crystalline condition and 125°C. when both crystalline and oriented. Nylon and other polymers behave similarly. It is preferable, therefore, to carry out this stage of the process at a temperature higher than the highest glass transition temperature expected for the synthetic polymer in question, thus above 125°C. for polyethylene terephthalate. The rate of fixation varies with temperature, higher temperatures causing more rapid fixation.

The fluorocarbon employed herein must meet certain requirements. First, it must have atmospheric pressure boiling points of at least about 125°C. so as to minimize both energy requirements and diffusional losses from equipment during operation of the invention process. Next, it must have a fluorine to carbon atom ratio of at least 1.5, that is, there must be at least 1.5 fluorine atoms per carbon atom in the molecule. Preferably, the fluorine to carbon atom ratio is at least 2.0. The remaining constituents of the molecule are usually hydrogen atoms, other halogens, particularly chlorine atoms, or hetero-atoms, in particular, ether oxygen or tertiary amine nitrogen atoms. The fluorocarbon must have a solubility parameter (as hereinafter defined) of not greater than 7.0. This is to ensure that the dye is sufficiently insoluble in the fluorocarbon to have a partition function which favors the polymer rather than the fixation medium. When the solubility parameter is no greater than 7.0, none of the fixation medium is imbibed by the fiber during dye fixation. In contrast, with a medium such as tetrachloroethylene, with a parameter of 9.7, polyester fiber will imbibe 3–10% by weight of tetrachloroethylene. Preferably, the solubility parameter of the normally liquid fluorocarbon employed herein is no greater than 6.5

There are a number of known, useful fluorocarbons having the aforementioned properties. These include the following, with the solubility parameters being given in parentheses if they have been measured or calculated: perfluoroaliphatic and perfluorocycloaliphatic hydrocarbons, such as perfluoro(1-methyldecalin) (6.4), perfluorophenanthrone, perfluorononane (5.8) and perfluoroundecane (5.6); perfluorokerosene constituents, such as perfluorotetradecane (5.6) and perfluorohexadecane (5.5); perfluoroethers including the hexafluoropropylene oxide polymers having molecular weights as high as several thousand, such as $F[CF(CF_3)CF_2O]_nCHFCF_3$ (5.5–6.5), n being an integer preferably at least 3, for example, 3–7, and $F[CF(CF_3)CF_2O]_mCF_2CF_3$, m being an integer preferably at least 4; and perfluoro (trialkylamines), such as perfluoro (tributylamine). Also included are chlorofluoroalkanes, such as 1-chloroperfluorodecane and perfluoroalkanes of 9 to 16 carbon atoms. The above listing is not intended to be complete. Any fluorocarbon or mixture of fluorocarbons having the required properties is meant to be included. Fluorocarbons which are not useful herein because they boil below 125° C. and/or have solubility parameters which are too high are tetrafluoromethane, chlorotrifluoromethane, dichlorodifluoromethane, trichlorofluoromethane (solubility parameter greater than 7.0), perfluorohexane, chlorodifluoromethane, hexafluoroethane, chloropentafluoroethane, 1,1,2-trichloro-1,2,2-trifluoroethane (solubility parameter 7.2) and octafluorocyclobutane. In general, unsaturated fluorocarbons, that is, fluorocarbons containing a >C=C< moiety, are excluded or undesirable because of their reactivities, especially with free amino groups, such as often are present in disperse dyes, and because they often are highly toxic. However, it has been found that such unsaturated fluorocarbons which have three or four perfluoroalkyl groups of 1–10 carbon atoms, preferably 1–3 carbon atoms, attached to the >C=C< moiety are useful herein because they are substantially non-reactive.

The solubility parameter of a liquid fluorocarbon can be calculated from the equation $$\delta = \left[\frac{\Delta H - RT}{V}\right]^{1/2}$$

where $\delta$ is the solubility parameter, in the units of (calories/cc.)$^{1/2}$; $\Delta H$ is the heat of vaporization per mole, $R$ is the gas constant, $T$ is the absolute temperature and $V$ is the volume per mole, all in consistent units. $\Delta H$, if not already known, is readily determined by standard methods. $V$, if not known, is easily calculated from the density of the compound by dividing it into the molecular weight. Critical temperature, if not known, can be closely estimated by using the empirical formula $T_c = 1.41T_B + 66 - 11F$. $T_c$ is the critical temperature in °K., $T_B$ is the boiling point in °K. at one atmosphere of pressure and $F$ is the number of fluorine atoms present in the molecule. $T_B$ can never be greater than $T_c$. The solubility parameter is a constant which characterizes each material; it is often known as the Hildebrand solubility parameter. The theory underlying the solubility parameter is that solvents tend to dissolve substances with similar solubility parameters but not substances with widely different solubility parameters. Since disperse dyes have high parameters, the liquid fluorocarbon should have a low parameter. The synthetic polymers which are useful herein also usually have high parameters; hence, the liquid fluorocarbons of low parameters are less likely to attack the polymer. The use of solubility parameters is well known, as exemplified by Burrell, Official Digest, Federation of Paint and Varnish Production Clubs ODFPA, 27, 726 (1958) and Burrell et al., Polymer Handbook, Brandrup et al., editors, John Wiley and Sons, New York, N.Y., 1966 (IV), page 341.

Fluorocarbons which are useful primarily in liquid phase fixation systems are those with atmospheric boiling temperatures above about 200°C. and include, with the solubility parameters shown in parentheses: the hexafluoropropylene oxide polymers of the formulas $F[CF(CF_3)CF_2O]_nCHFCF_3$ (5.5 – 6.5) and $F[CF(CF_3)CF_2O]_nCF_2CF_3$ (about 5.5) wherein $n$ is 5 to such a value as to provide molecular weights as high as several thousand, but preferably 5–9, perfluorokerosene constituents, such as perfluorotetradecane and higher boiling perfluoroalkanes, and chloroperfluoroalkanes, such as 1-chloroperfluorododecane. When using the fluorocarbons as liquids, a bath of the liquid is heated to the desired fixation temperature and the padded or printed synthetic polymer is immersed or passed through the heated liquid for the desired length of time. Any suitable apparatus can be used, for example, that shown in U.S. Pat. No. 3,667,898, supra.

Fluorocarbons which are useful as saturated vapors, that is, vapors in thermal equilibrium with the boiling liquid, as superheated vapors or as liquids include, with the solubility parameters shown in parentheses: the hexafluoropropylene oxides of the formulas $F[CF(CF_3)CF_2O]_3CHFCF_3$ (about 6.0) and $F[CF(CF_3)CF_2O]_3CF_2CF_3$ (about 6.0), both having a b.p. of about 152°C.; perfluoro(1-methyldecalin) (about b.p. 160°C.; perfluoro-1,3,5-trimethylcyclohexane (about 5.5), b.p. 125°C.; chloroperfluorooctane, b.p. 132°–153°C.; 1-chloroperfluorodecane, b.p. 169°–171°C.; and perfluorotributylamine (about 6.0), b.p. 180°C.

When the fluorocarbon is used as a saturated vapor, the padded or printed synthetic polymer is immersed in the vapors of the boiling liquid. Such a system requires means (well known in the art) for condensing the vapors to prevent their escape from the system.

The restriction as to boiling temperature of the fluids of the invention restricts the claimed fluids to those of relatively high molecular weight. The fluids of high boiling temperature and of high molecular weight within the invention maximize energy utilization over that characteristic of art compounds of lower molecular weight such as, for example, perfluorohexane, perfluoroheptane and perfluorooctane.

When the fluids of the invention are employed in the superheated condition, it is substantially more efficient to employ a fluid having a boiling temperature close to the use temperature.

Fluids of high boiling temperature and molecular weight are more easily confined in devices for carrying out the invention process than are fluids of the art. They are more easily condensed and diffusional losses are substantially reduced below those characteristic of fluids of lower molecular weight and boiling temperature. With increasing molecular weight the fluorocarbon fluid has lessened tendency to attack gaskets and other organic materials of construction; the solubility parameter decreases with molecular weight. The considerations give the designer options not available when using art fluids. This leads to simpler devices for carrying out the processes of the invention. When the fluorocarbon is used as a liquid, the same procedures are used as described above for the padding or printing operation.

The use of the materials listed above which are used in the form of superheated vapors requires suitable equipment for boiling, superheating the vapor produced, contacting the synthetic polymer with such vapor and condensing the spent vapor. Such equipment is known in the prior art, for example, that cited above. To provide a practical process, from an energy standpoint, in this equipment, however, it is necessary that the fluorocarbon fluid have the properties listed above.

If fixation of dye is not complete, if residual fluorocarbon remains on the polymer or if an undesirable pad bath additive, such as a thickening agent, is retained on the polymer, scouring may be desirable. For incomplete fixation either a solvent scour, for example, with trichlorotrifluoroethane, or an aqueous detergent scour can be used. When an entirely water free system is desired, a solvent scour is preferred. If fluorocarbon is retained on the polymer, a solvent scour with trichlorotrifluoroethane is preferred. If a water soluble material, such as an aqueous pad bath thickener, is retained by the polymer, an aqueous detergent scour is preferred. If the polymer is subjected to a solvent scour, recovery of the solvent by conventional means is desirable.

It has been found that, unlike perchloroethylene and other fixation agents disclosed in the art, the fluorocarbons employed herein are not imbibed or absorbed in the synthetic polymers. As a result, it generally is not necessary to treat the polymer after dye fixation herein to remove the fluorocarbon. It also has been found that the process of this invention can be used to heat set fabrics. Heat set occurs when a fabric of a synthetic polymer is heated above its glass transition temperature, formed into a desired shape, for example, a crease, then cooled in the desired shape to below its glass transition temperature.

In the examples which follow parts are by weight unless otherwise stated. The dyes used in the examples are all known dyes which are identified by formula in Table I. Unless otherwise specified polyester refers to commerically available polyethylene terephthalate.

TABLE I

| Designation | Formula | Color |
|---|---|---|
| A | 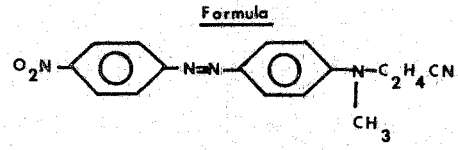 | Orange |

TABLE I (continued)
| Designation | Formula | Color |
|---|---|---|
| B | 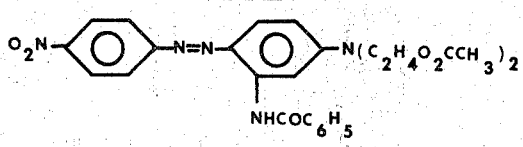 | Red |
| C | 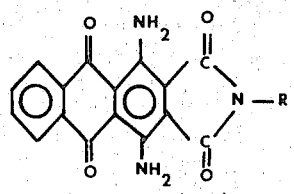 R = mixture of $-C_2H_4OH$, $-(CH_2)_3OCH_3$ and $-(CH_2)_3OCH(CH_3)_2$ | Blue |
| D | 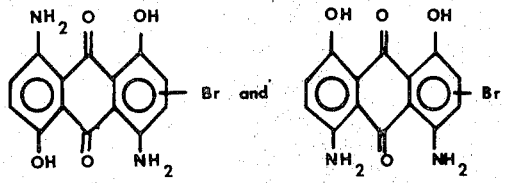 | Blue |
| E | 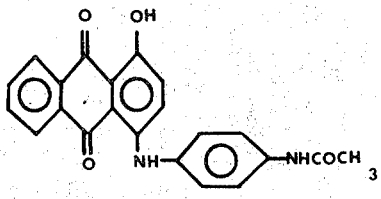 | Blue |
| F | 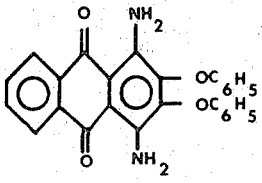 | Violet |
| G | 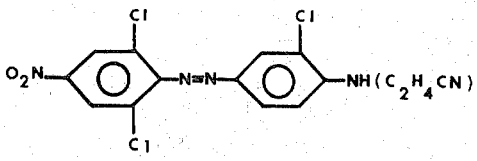 | Yellow |
| H | 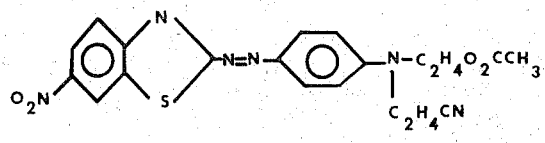 | Red |
| I | 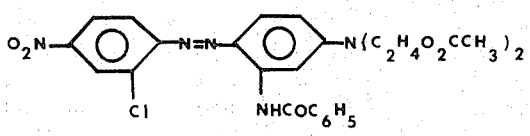 | Red |
| J | 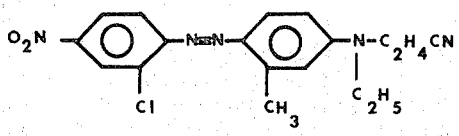 | Red |
| K | 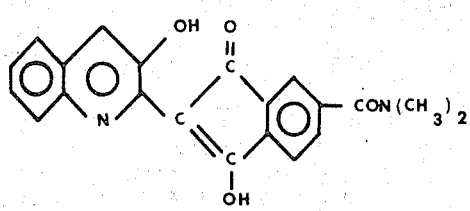 | Yellow |

EXAMPLE 1

A mixture of 0.4 g. of dye A, 0.4 g. of $F[CF(CF_3)CF_2O]_9CF(CF_3)CO_2H$ and 20 ml. of $F[CF(CF_3)CF_2O]_3CHFCF_3$ was stirred and then subjected to ultrasonic agitation for 2 minutes. The resulting dispersion was added to 180 ml. of 1,1,2-trichloro-1,2,2-trifluoroethane. The final dye dispersion was padded on to an 8.10 × 45.72 cm. piece of polyester double knit fabric. A 6.35 × 6.35 cm. piece of the fabric padded with dye A was immersed in an agitated bath of 100 ml. of $F[CF(CF_3)CF_2O]_3CHFCF_3$ at 130°C. for 2 minutes. The fabric was then removed, immersed in 1,1,2-trichloro-1,2,2-trifluoroethane at room temperature, scoured in N,N-dimethylacetamide at room temperature, rinsed again in 1,1,2-trichloro-1,2,2-trifluoroethane at room temperature and air dried. A weighed sample of the fabric was then extracted with hot dimethylacetamide. The dye content of the trichlorotrifluoroethane and dimethylacetamide room temperature washings (containing unfixed dye) and the dye content of the hot dimethylacetamide extract (containing fixed dye) were determined by visible spectroscopy and, from the results, % dye utilization was calculated.

The above procedure was repeated with fabric padded with dye A at 140°C. for 2 minutes and at 152°C. for 1, 2 and 5 minutes.

All the above was repeated with fabric padded with 0.4 g. of dye E at the same time-temperature combinations. The results are shown in Table II.

TABLE II

| Temp. (°C.) | Time (min.) | Dye A Appearance | % Dye Utilization | Dye E Appearance | % Dye Utilization |
|---|---|---|---|---|---|
| 130 | 2 | light orange, weak dyeing | 14 | light blue, weak dyeing | 09 |
| 140 | 2 | orange, moderately strong dyeing | 28 | medium blue, moderate dyeing | 23 |
| 152 | 1 | orange, strong dyeing | 79 | blue, fairly strong dyeing | 31 |
| 152 | 2 | orange, strong dyeing | 92 | blue, fairly strong dyeing | 42 |
| 152 | 5 | orange, strong dyeing | 99 | blue, strong dyeing | 58 |

A 6.35 × 6.35 cm. piece of fabric padded as described above with dye A was hung from a wire frame in a hot air oven at 150°C. After two minutes the fabric was removed, cooled to room temperature, scoured with dimethylacetamide, rinsed with trichlorotrifluoroethane and dried. A weighed sample was extracted with hot dimethylacetamide and dye content was determined as above. The procedure was repeated by heating at 150°C. for 5, 15 and 30 minutes, at 170°C. for 2 minutes and at 200°C. for 2 minutes. It was also repeated using a 6.35 × 6.35 cm. piece of fabric padded with dye E at the six temperature-time combinations. The results are shown in Table III.

TABLE III

| Temp. (°C.) | Time (min.) | Dye A Appearance | % Dye Utilization | Dye E Appearance | % Dye Utilization |
|---|---|---|---|---|---|
| 150 | 2 | very light orange | 5 | very light blue | 3 |
| 150 | 5 | light orange | 13 | light blue | 8 |
| 150 | 15 | fairly strong dyeing | 45 | weak dyeing | 22 |
| 150 | 30 | strong dyeing | 86 | strong dyeing | 70 |
| 170 | 2 | fairly strong dyeing | 39 | weak dyeing | 18 |
| 200 | 2 | strong dyeing | 94 | strong dyeing | 59 |

The above results indicate that one minute immersions in the fluorocarbon liquid gave dyeings equal to or better than those achieved at 200°C. for 2 minutes or 150°C. for fifteen minutes in the air oven. Dye A is representative of low energy dyes and dye E is representative of high energy dyes, the terms low and high being qualitative indications of the energy required to effect fixation.

EXAMPLE 2

Polyester double knit fabric was padded with a solution of dye A in dimethylformamide and dried. A 10.16 × 15.24 cm. piece of the padded fabric was immersed for 5 seconds in $F[CF(CF_3)CF_2O]_5CHFCF_3$ at 210°C., removed and immersed in trichlorotrifluoroethane at room temperature. After scouring with dimethylacetamide at room temperature, rinsing in trichlorotrifluoroethane and drying, the fabric was extracted with hot dimethylacetamide. Visible spectroscopic analyses indicated 99% dye fixation.

A similar high level of dye fixation was achieved in perfluorokerosene at 200°C. for 5 seconds. Cross sections of fibers in both dyeings showed complete and uniform dye penetrations.

EXAMPLE 3

A continuous dyeing apparatus was assembled so as to consist of a pad bath, a fixation unit and a wind-up device. The pad bath was a stainless steel vessel 7.62 cm. wide, 15.24 cm. long and 12.70 cm. deep with 2 adjustable dip bars of 1.27 cm. polytetrafluoroethylene rod. A 1.27 cm. polytetrafluoroethylene roller was used as a squeeze roll. The fixation unit consisted of a 3.81 cm. wide, 7.62 cm. long and 21.59 cm. deep stainless steel electrically heated tank fitted with a 1.27 cm. polytetrafluoroethylene rod on the feed lip, an adjustable 1.27 cm. polytetrafluoroethylene rod and a 20.32 cm. long by 5.08 cm. wide chute, inclined upwardly 30° from the horizontal to the wind-up device. The wind-up device was a slow speed electric motor fitted with a 7.62 cm. shaft of 0.635 cm. (outer diameter) copper tubing covered with polyethylene tubing having wires imbedded therein to hold the fabric.

A pad bath was prepared by dissolving 2.5 g. of dye C in 25 ml. of dimethylformamide, filtering the solution and adding it to a solution of 0.5 g. of surfactant in 780 ml. of 1,1,2-trichloro-1,2,2-trifluoroethane, the surfactant being the 2-ethylhexylamine salt of (iso-octyl $O)_aP(O)(OH)_{3-a}$ wherein $a$ is 1 and 2, average 1.5. The fixation unit was filled with $F[CF(CF_3)CF_2O]_6CHFCF_3$ to a depth of 11.43 cm. and heated to 200°C. The adjustable rod was fixed at 7.62 cm. The wind-up device was adjusted to 15.24 cm./10 second takeup rate. A 5.08 cm. wide × 76.20 cm. long strip of polyester double knit fabric was fed through the apparatus, fixation time being 10 seconds. The collected fabric was rinsed with trichlorotrifluoroethane and scoured with acetone at room temperature; dye fixation was essentially complete.

EXAMPLE 4

This example was carried out in a conventional solvent steamer, for example, as disclosed by Byland et al., supra, which permits fixation with superheated vapors. The heating bath was filled with silicone oil. Vapors of $F[CF(CF_3)CF_2O]_3CHFCF_3$, b.p. 152°C., heated to 194°C. were used. A 5.08 × 7.62 cm. piece of polyester double knit fabric, padded with dye C from a dispersion prepared by filtering a solution of 0.1 g. of the dye in 2.0 g. of dimethylformamide with sirring into 40 ml. of 1,1,2-trichloro-1,2,2-trifluoroethane, was suspended in the superheated vapor for 15 seconds. The fabric was then removed, rinsed with trichlorotrifluoroethane and air dried. After scouring with dimethtylacetamide at room temperature, dye fixation (determined from visible spectroscopic analyses) was found to be 43%.

EXAMPLE 5

Polyethylene terephthalate film (0.381 mm. thick) was padded with a 1% solution of dye C in dimethylformamide at 80°C. and air dried. Similar film samples were padded with 1% solutions in dimethylformamide of dyes F and G and a 2% solution of dye J and air dried. Each padded film sample was immersed for 10 seconds in $F[CF(CF_3)CF_2O]_nCHFCF_3$, $n = 6.5$ average, at 200°C. (liquid at this temperature), scoured in trichlorotrifluoroethane and then dimethylacetamide. Each piece of film was dyed strongly.

The above procedure was repeated except that the padded film samples were contacted for 10 seconds with the vapors of $F[CF(CF_3)CF_2O]_4CHFCF_3$ 194°C.

The film samples were extracted with hot dimethylacetamide to remove all dye; visible spectral analyses of the resulting solutions indicated the dye fixations shown in Table IV.

TABLE IV

| Dye | % Dye Fixation $F[CF(CF_3)CF_2O]_{6.5}CHFCF_3$ |
|---|---|
| C | 96 |
| F | 94 |
| G | 49 |
| J | 83 |

TABLE IV-continued

| Dye | $F[CF(CF_3)CF_2O]_4CHFCF_3$ |
|---|---|
| C | 81 |
| F | 84 |
| G | 54 |
| J | 76 |

EXAMPLE 6

A dye dispersion was prepared by adding a filtered solution of 2.5 g. of dye A in 25 ml. of dimethylformamide to a stirred solution of 0.5 g. of the surfactant of Example 3 in 780 ml. of 1,1,2-trichloro-1,2,2-trifluoroethane. Two pieces of a multifilament test fabric were padded with this dispersion. Another two pieces were immersed in boiling water for 5 minutes, patted dry with paper toweling and then padded with the dye dispersion. The fabric contained 13 different weft yarns (shown in Table V) arranged in strips 0.79 cm. wide.

One piece of fabric from each of the above paddings was immersed in $F[CF(CF_3)CF_2O]_3CHFCF_3$ at 152°C. for 20 seconds, then scoured with trichlorotrifluoroethane. A second piece of fabric from each of the above paddings was immersed in $F[CF(CF_3)CF_2O]_nCHFCF_3$, $n = 6.5$ average, at 200°C. for 10 seconds and then scoured with trichlorotrifluoroethane. Each piece of fabric was then scoured with a commerical aqueous sodium alkyl ether sulfate surfactant solution. Table V shows the nature of the dyeings obtained with each method of fixation. The dye fixations conducted in $F[CF(CF_3)CF_2O]6.5CHFCF_3$ were slightly stronger in the fabric which was padded while dry.

TABLE V

| Yarn | $F[CF(CF_3)CF_2O]_3CHFCF_3$ | $F[CF(CF_3)CF_2O]_{6.5}CHFCF_3$ |
|---|---|---|
| Acetate (dull) | Strong | Strong |
| "Acrilan" 1656 (acrylic) | Tinted | Stained |
| "Arnel" (dull)(triacetate) | Strong | Strong |
| Cotton (raw) | None | None |
| "Creslan" 61 (acrylic) | Tinted | Stained |
| "Dacron" 54 (polyester) | Strong | Strong |
| "Dacron" 64 (cationic dyeable polyester) | Strong | Strong |
| Nylon 66 | Strong | Moderate |
| "Orlon" 75 (acrylic) | Tinted | Stained |
| Silk | Stained | Tinted |
| "Verel" H (modacrylic) | Strong | Strong |
| Viscose | None | None |
| Wool | Stained | Stained |

EXAMPLE 7

A folded piece of polyester double knit fabric was padded with a solution of dye E in dimethylformamide and then passed through superheated vapors of $F[CF(CF_3)CF_2O]_4CHFCF_3$ at 200°C., using the apparatus of Example 4, for 9 seconds. The procedure was repeated using vapor contact times of 22 seconds and 95 seconds. Each piece of fabric was scoured in turn in trichlorotrifluoroethane and acetone. Dye fixation was excellent in all cases and each fabric piece had a sharp crease corresponding to the fold line. Each fabric piece was spread open and dry ironed at an iron temperature of 116°C. The ironing did not remove the creases, indicating that the fabrics were heat set.

EXAMPLE 8

Five printing pastes were formulated so as to contain 5% urea; 60% of a natural gum thickener (as a 5%, neutralized aqueous solution); 3% of dye H or 6% of dye B, I or D or 6% of dye E (as a 50% aqueous paste); and water (to make 100%). Polyester double knit fabric was printed with a stripe of each paste formulation.

Two strips of the printed fabric were cut so as to include each of the printed dyes. One strip was passed through $F[CF(CF_3)CF_2O]_nCHFCF_3$, $n = 6.5$ average, at 200°C. (liquid at this temperature) for 12 seconds. It was then rinsed with trichlorotrifluoroethane and given an aqueous scour. The dyes were fixed, strong and level; no bleeding occurred. The second strip was passed through superheated vapors of $F[CF(CF_3)CF_2O]_5CHFCF_3$ at 235°C. for 4.6 seconds. After rinsing and scouring as above, the dyes were found to be fixed strongly; no bleeding occurred.

EXAMPLE 9

Padding was carried out (about 100% wet pickup, based on weight of fiber) on polyester double knit fabric with an aqueous pad liquor containing 75 g./liter of dye F (in paste form), 15 g./liter of a commerical thickening agent and 1 g./liter of a commerical sodium alkylaryl sulfonate surfactant. Immediately after padding the fabric was passed through an infrared predrier and then further dried in a dry box at 71°–82°C. The dried padded fabric was then passed through the fixation apparatus described in Example 3 containing $F[CF(CF_3)CF_2O]_nCHFCF_3$, $n = 6.5$ average, at 199°C. and saturated with dye F (solubility at 200°C.:0.026% by weight). Samples of the padded fabric were fixed for 10, 15, 20, 25 and 90 seconds. After removal from the hot fluorocarbon fluid the fabric samples were rinsed with trichlorotrifluoroethane, dried and scoured for 5 minutes at 93°C. in an aqueous solution of 1 g./liter of caustic soda, 1 g./liter of sodium hydrosulfite and 0.5 g./liter of C-cetyl betaine (25% active ingredient). The scoured samples were rinsed with water, dried, ironed and a sample of each was extracted with hot chlorobenzene to determine dye content spectrophotometrically. Utilizations of dye are shown in Table VI.

TABLE VI

| Fixation Time (sec.) | % Dye Utilization |
|---|---|
| 10 | 71 |
| 15 | 74 |
| 20 | 74 |
| 25 | 76 |
| 90 | 88 |

A piece of fabric padded as above was fixed by the "Thermosol" procedure by heating in an air oven at 199°C. for 90 seconds; the dye utilization was 79%.

Fabric padded as above (except that dye A was employed) was fixed as above at 200°C. for 6 seconds, giving a dye utilization of 97%. The "Thermosol" procedure at 199°C. required 90 seconds to attain 98% dye utilization.

EXAMPLE 10

Polyester double knit fabric was padded as in Example 9. Using the superheated vapor fixation apparatus described in Example 4, rates of dye fixation were determined using certain fluorocarbons, tetrachloroethylene and the "Thermosol" procedure. The dyes and pad bath concentrations used were: dye K (10 g./liter), dye E (37.5 g./liter) and dye A (75 g./liter). The results are shown in Table VII.

TABLE VII

| Fixation Method | Time (sec.) | Dye Fixation |
|---|---|---|
| **Dye A** | | |
| $F[CF(CF_3)CF_2O]_5CHFCF_3$ (232°C.) | 10.5 | 86.7 |
| | 20.0 | 85.4 |
| | 53.0 | 84.7 |
| | 75.0 | 81.7 |
| "Thermosol" (213°C.) | 10.0 | 66.8 |
| | 20.0 | 74.8 |
| | 50.0 | 80.2 |
| | 90.0 | 79.5 |
| 37 Thermosol" (199°C.) | 10.0 | 33.9 |
| | 20.0 | 64.4 |
| | 50.0 | 77.8 |
| | 90.0 | 81.5 |
| $F\ CF(CF_3)CF_2O]_4CHFCF_3$ (200°C.) | 10.5 | 55.1 |
| | 21.5 | 67.9 |
| | 51.5 | 75.6 |
| | 95.0 | 78.3 |
| Tetrachloroethylene (200°C.) | 10.0 | 4.8 |
| | 20.0 | 43.0 |
| | 42.0 | 65.7 |
| | 86.0 | 78.8 |
| $F[CF(CF_3)CF_2O]_3CHFCF_3$ (200°C.) | 11.0 | 8.8 |
| | 20.5 | 43.7 |
| | 56.0 | 63.7 |
| | 75.0 | 64.9 |
| **Dye E** | | |
| $F[CF(CF_3)CF_2O]_4CHFCF_3$ (200°C.) | 10 | 75.9 |
| | 19 | 85.0 |
| | 60 | 87.2 |
| | 97 | 87.4 |
| "Thermosol" (213°C.) | 10 | 70.9 |
| | 20 | 79.1 |
| | 50 | 85.5 |
| | 70 | 84.8 |
| | 90 | 89.1 |
| "Thermosol" (199°C.) | 10 | 17.7 |
| | 20 | 44.0 |
| | 50 | 74.1 |
| | 70 | 78.0 |
| | 90 | 85.5 |
| Tetrachloroethylene (200° C.) | 10 | 18.4 |
| | 23 | 53.0 |
| | 54 | 77.1 |
| | 98 | 84.6 |
| **Dye K** | | |
| $F[CF(CF_3)CF_2O]_4CHFCF_3$ (200 °C.) | 8.0 | 74.1 |
| | 9.0 | 76.0 |
| | 21.0 | 86.3 |
| | 50.0 | 88.0 |
| | 89.0 | 87.2 |
| "Thermosol" (213°C.) | 10.0 | 63.1 |
| | 20.0 | 76.5 |
| | 50.0 | 82.2 |
| | 70.0 | 85.4 |
| | 90.0 | 90.6 |
| "Thermosol" (199°C.) | 10.0 | 15.6 |
| | 20.0 | 53.6 |
| | 50.0 | 81.5 |
| | 70.0 | 84.1 |
| | 90.0 | 86.6 |
| Tetrachloroethylene (200°C.) | 11.0 | 21.7 |
| | 21.0 | 44.3 |
| | 58.0 | 79.5 |
| | 96.0 | 85.6 |

The above data demonstrate four points: (1) fixation rates are highly temperature dependent and comparisons must be made at the same temperature; (2) the fluorocarbon $F[CF_2(CF_3)CF_2O]_4CHFCF_3$ gives more rapid rates of fixation than either "Thermosol" or perchloroethylene; (3) all methods ultimately reach approximately the same degree of fixation; and (4) the degree of fixation of dye A decreases with time with $F[CF(CF_3)CF_2O]_5CHFCF_3$ at 232°C. (this may be due to higher dye solubility at the higher temperature, indicating fixation times at such high temperatures should be limited to the minimum).

EXAMPLE 11

Polyester double knit fabric was padded with a solution of dye E in dimethylformamide. After drying the fabric was cut into 16 pieces weighing about 1 gram each. Each 1 gram piece was then cut in half, one half being weighed and extracted to determine dye content, the other half being immersed in one of the eight fixation baths (at 200°C.) shown in Table VIII, heated for 10 seconds, removed and immediately immersed in trichlorotrifluoroethane at room temperature. Each piece of fabric was then scoured with acetone at room temperature. Finally, fixed dye contents were determined by extraction of the samples with hot dimethylacetamide followed by spectrometric analyses.

The entire procedure was repeated using dye C. The results of both series are shown in Table VIII.

TABLE VIII

| Fixation Medium | % Dye Fixation Dye E | Dye C | Appearance |
|---|---|---|---|
| $F[CF(CF_3)CF_2O]_{6.5}CHFCF_3$ | 79 | 75 | strong, level clean dyeing |
| n-Dodecane | 25 | 12 | weak dyeing |
| Ceresin wax,m.p.14.4°C. | 2 | 19 | weak dyeing |
| Paraffin wax, m.p. 54.5°C. | 20 | 6 | weak dyeing |
| Microcrystalline wax | 20 | 27 | weak dyeing, very difficult to remove from fabric |
| Woods Metal | 67 | 99 | strong dyeing, particles of metal adhere to fabric |
| $NANO_2/KNO_3$ melt (1/1 by weight) | 76 | 74 | strong dyeing but off-shade (may be due to oxidation of dye |
| Adduct of 20 moles of ethylene oxide and 1 mole of Sperm Oil alcohol | 22 | 4 | weak dyeing |

EXAMPLE 12

Polyester double knit fabric was padded with a dispersion of dye C in 1,1,2-trichloro-1,2,2-trifluoroethane, a fluorocarbon outside the invention fluorocarbon definition. After drying the padded fabric was passed through a vapor bath of superheated 1,1,2-trichloro-1,1,2-trifluoroethane vapors at 150°C. with a hold time of 195 seconds. A second padded piece was passed through the same vapor bath for 55 seconds. In both cases the apparatus used was that described in Example 4. Analysis indicated 76% dye fixation after 55 seconds of exposure and 65% dye fixation after 195 seconds of exposure. The decreased dye fixation on longer exposure is believed to have been due to a limited dissolution of dye in a small amount of fluorocarbon vapor which condensed.

EXAMPLE 13

Polyester double knit fabric was padded with a dispersion of dye F in 1,1,2-trichloro-1,2,2-trifluoroethane. After drying at room temperature, a piece of the padded fabric was immersed in perfluorotributylamine at its boiling point (180°C.) for 15 seconds. Fixation was strong and the dyeing was crock free. A second piece of the padded fabric was immersed in the vapor of boiling perfluorotributylamine for 30 seconds. Again, fixation was very strong and the dyeing was crock free.

I claim:

1. Process wherein an organic disperse dye is applied to a synthetic organic polymer in the form of a film or textile fabric by spraying, printing or padding and the dye-containing film or fabric is then passed through a fluorocarbon fluid at a temperature greater than the glass transition temperature of the polymer for sufficient time to fix the dye in the polymer, said fluorocarbon having a boiling temperature of at least 125°C. and having a fluorine to carbon atom ratio of at least 1.5 and a solubility parameter of not greater than 7.0.

2. Process of claim 1 wherein the polymer is a nylon.

3. Process of claim 1 wherein the polymer is a polyester.

4. Process of claim 3 wherein the polyester is a polyethylene terephthalate.

5. process of claim 1 wherein the solubility parameter is less than 6.5.

6. Process of claim 5 wherein the fluorocarbon is a perfluoroalkane of 9 to 16 carbon atoms.

7. Process of claim 5 wherein the fluorocarbon is of the formula $F[CF(CF_3)CF_2O]_mCF_2CF_3$ wherein $m$ is at least 4.

8. Process of claim 5 wherein the fluorocarbon is of the formula $F[CF(CF_3)CF_2O]_nCHFCF_3$ wherein $n$ is at least 3.

9. Process of claim 8 wherein $n$ is 3–7.

10. Process of claim 5 wherein the fluorocarbon is perfluorotributylamine.

11. Process of claim 1 which is carried out continuously.

12. Process of claim 1 wherein the dye-treated film or fabric is dried before being passed through the fluorocarbon fluid.

13. Process of claim 1 wherein the dyed film or fabric is heat set.

* * * * *